United States Patent [19]

Delker

[11] 4,106,131

[45] Aug. 15, 1978

[54] WATER DISTRIBUTOR FOR SIPHON CLOSET

[75] Inventor: Wilfried Delker, Bonn-Beuel, Fed. Rep. of Germany

[73] Assignee: American Standard Inc., New York, N.Y.

[21] Appl. No.: 786,245

[22] Filed: Apr. 11, 1977

[30] Foreign Application Priority Data

Apr. 15, 1976 [DE] Fed. Rep. of Germany ..... 2616742

[51] Int. Cl.[2] ..... A47K 17/00; E03D 11/00

[52] U.S. Cl. ..... 4/1; 4/420; 4/421; 4/425

[58] Field of Search ..... 4/1, 69 R, 10, 89, 12, 4/73, 213

[56] References Cited

U.S. PATENT DOCUMENTS

| | | | |
|---|---|---|---|
| 3,212,106 | 10/1965 | Noel | 4/69 |
| 3,843,977 | 10/1974 | Garnett | 4/69 |
| 4,006,497 | 2/1977 | Mollerstedt | 4/1 |

*Primary Examiner*—Henry K. Artis

*Attorney, Agent, or Firm*—James J. Salerno, Jr.; Robert G. Crooks

[57] ABSTRACT

A water distributor adapted for use in a siphon closet of the type provided with an open flush rim. The distributor includes a strip of material adapted to be inserted and positioned in a siphon closet to at least partially close the open flush rim therein. An arrangement of apertures are in the distributor to form passageways from the at least partially closed flush rim. The distributor is inexpensive to manufacture and can be simply and efficiently installed. It is formed of a material of limited flexibility so that it need only be flexed, pressed into the open flush rim of the siphon closet from below and released. The distributor is formed of a single inexpensive element and no additional fasteners are required for installation. The distributor is not visible when installed and is relatively permanent and can only be removed by an expert with special tools.

6 Claims, 3 Drawing Figures

WATER DISTRIBUTOR FOR SIPHON CLOSET

BACKGROUND OF THE INVENTION

The present invention is concerned with a water distributor adapted for use in a siphon closet of the type provided with an open flush rim to which the distributor can be coupled.

Certain types of water distributors for siphon closets having an open flush rim are well known. For example, the water distributor plate has been pre-cast and then put into the final mold before the main piece of bowl is cast. Alternatively, the separate cast piece has been mounted by bonding in certain forms. In general, in these known devices, the water distributor is mounted between the apron, the part of the flush rim protruding toward the center of the bowl, and the upper bowl wall of a siphon closet. In that position, the distributor with appropriate openings directs the flush water directly into the center of the bowl and along the adjacent bowl walls. Additional quantities of water travel to the front region of the bowl beyond the water distributor and stream from that direction into the bowl to provide the desired flush capacity.

A siphon closet of the type presently under consideration includes a flush plate which directs two principal flush water streams, equally strong, at the left and at the right side respectively mainly along the upper bowl rim into the front region of the bowl where they meet, and from that point they stream into the flush funnel. Partial quantities of these two principal flush water streams flush the lateral bowl walls. A tooth system, forming passage apertures together with the bowl walls, is placed below the flushing plate for flushing the rear bowl wall with an adjoining flush water flow.

A disadvantage of these designs is the comparatively expensive cost of production. The flush plates have to be separately manufactured and be bonded to the siphon closet or, alternatively, inserted into a pre-casting.

Another type of siphon closet with an open flush rim includes a flush bar instead of a flush plate. The flush process is the same as that utilized with the flush plate design. The flush bar is mounted between the flush water inlet and the apron of the flush rim. The bar is provided with a central passage aperture for flushing the rear bowl wall by passage therethrough of water from the adjoining flush water flow. This water clashes against the apron of the flush rim and from there it streams across the rear bowl wall. This design is also comparatively expensive to produce since the flush bars have to be manufactured separately and be put into the pre-casting as well.

Another type of well known siphon closet is one which has a partially or completely closed flush rim and the flush water is directed into the bowl in the same manner as the previously discussed designs. During the flush process, the flush rim is essentially filled with water. The flush rim is provided with passage apertures which are partially slot-shaped for passage of the water therethrough to be used in flushing the bowl walls. Constructions of this kind are also comparatively expensive to produce. The flush rim is manufactured in a hollow casting and the numerous passage apertures are then pierced and cut before the flush rim is bonded to the remainder of the siphon closet.

The known siphon closets which utilize a closed flush rim have the above disadvantages. However, it is possible to arrange the passage apertures in the flush rim in a manner which permits the flush water to come out vertically. Normally, however, most of the passage apertures are arranged at an angle to the vertical. The flush water passing through these apertures gets a rotating movement which increases the flush capacity. It is an advantage to arrange some of the passage apertures vertically in order to direct some streams of water into the middle of flush funnel.

It is also known to separately manufacture a water distributor in the form of a hollow body which is thereafter built into an open flush rim of a siphon closet.

In German Design Pat. No. 1,758,592 an inlet water distributor is arranged behind a projection in a siphon closet and protrudes a downward and inward into the middle of the bowl from the upper bowl rim. The distributor has a tube, open at both ends and provided with a lateral inlet aperture and with a connection piece surrounding this aperture and protruding outward. The distributor is screwed to a ring nut in which the end of the inlet conduit is located.

German Design Pat. No. 1,976,694 shows a comparable design.

Another type of hollow flush water distributor for a siphon closet which is well known is one in which the distributor is in the area of the water inlet mouth between the closet rim and the interior water rim. The distributor is manufactured as an independent structural member and is housed in a sleeve, lying in the preferably standardized water inlet connection piece, or by the water inlet connection piece itself serving as the sleeve, whereby the connection between the flush water distributor and the sleeve or the flush water distributor respectively and the water inlet connection piece is designed as a fixed connection. This arrangement is shown in German Design Pat. No. 1,976,997.

German Pat. No. 1,658,261 and U.S. Pat. No. 1,142,249 show flush water distributors which are comparable to the above designs. The distributors, described and shown therein, are in the shape of curved hollow bodies and are also provided with a connection piece for a direct connection with the flush water inlet.

Finally, another known type of flush water distributor for a siphon closet is one which is made of a plastic pipe bent in the form of a horseshoe, the pipe has only a recess in its central part for the access of the flush water in accordance with Patent No. CH-PS 425,668. The flush water distributor is built in by bending the plastic pipe and pressing it into the opened flush rim while it is still hot. After cooling, it rests tightly against the wall of the flush rim.

All of the above discussed designs with separately manufactured and later built in flush water distributors in the shape of hollow bodies have the disadvantage that they are also comparably expensive to produce. The hollow bodies are rather expensive constructions, they require an extensive amount of time to fit, and they partially require special mounting elements.

German Registered Design No. 7,437,535 deal with wash down or siphoning closets with guides for two main flush water flows which are provided following the flush water inlet. This type of siphon closet is cheaper to produce. The guide for one main flush water flow at one side of the closet goes into an open flush rim in a well known manner while the guide for the other main flush water flow ends in the rear region of the closet bowl.

This design, well tried in principle, is comparably cheap to produce. The flush water distributor does not have to be inserted into the pre-casting, does not have to be bonded, and does not have to later be built in as a separately manufactured body. This type of closet has practically the same flush capacity as the above discussed more expensive designs. The one main flush water flow, coming into the flush rim at one side of the closet, flushes practically the entire bowl walls — except for the rear region — before it runs into the flush funnel. Here it causes a rotational movement. An optimal flush capacity is reached together with the second main flush water flow streaming practically directly into the rear region of the bowl and falling on the flush water level by means of a pressure, the effect of which reaches down the outlet. A central passage aperture is provided for a side — flushing water flow in a flushing bar arranged between the flush water inlet and the apron of the flush rim for flushing the rear bowl wall. It bounces against the apron and from there it streams across the rear bowl wall. These designs have the disadvantage that the flush capacity is not always optimal because of differences in the fininshing tolerance of the guides for the two main flush water flows, which are arranged after the water inlet.

It is apparent that there is a need to remove the disadvantages of the above discussed known designs and to produce a water distributor for use in a siphon closet where the flush water distributor is manufactured separately and later built into the flush water rim in a manner which guarantees a safe mode of operation while maintaining inexpensive manufacturing and installation costs.

SUMMARY OF THE INVENTION

With the above background in mind, it is among the primary objectives of the present invention to provide a water distributor for a conventional type of siphon closet utilizing an open flush rim where the open flush rim is at least partially closed on its underside by means of a flexed and, for example, flat flush water distributor formed of a strip of material and being curved and arcuate in cross section and having an arrangement of apertures therein to form passageways from the at least partially closed flush rim.

In the unflexed condition, the flush water distributor has a larger radius of curvature than the flush rim. After flexing of the distributor and fitting it in position in the siphon closet it extends diagonally in the cross section across the flush rim and is attached at one end to the interior wall of the flush rim apron at its highest point and the upper bowl wall spaced from the flush rim apron at its lowest point.

A further characteristic of the present invention is that the flush water distributor is formed of flexible material so that it is mounted in the siphon closet under tension tending to return to its unflexed condition and thus is fixed in position. There are many acceptable materials of reasonable cost that can be utilized to form the flush water distributor with the distributor retaining its ability to be appropriately flexed and yet to have sufficient strength and rigidity to permit its mounting in position as a fixed part of the siphon closet. For example, the distributor can be formed of stainless steel or any conventional strong and flexible plastic material such as polyethylene, polypropylene and polyvinylchloride. The material should have sufficient strength and rigidity to tend to expand after flexing, insertion and release and to engage or snap into engagement with adjacent surfaces to hold the distributor in position.

The lower edge of the flush water distributor which attaches to the upper bowl wall is provided with recesses for engaging with projections on the bowl wall in alignment therewith to cooperate in securing the distributor in position in the siphon closet. Additional passage apertures are provided in the lower edge of the distributor to form passageways directed downward in cooperation with the adjacent bowl walls for flow of flush water therethrough in the desired flow pattern. The flush rim apron spaced from the bowl wall is provided with projections extending toward the bowl wall which engage with the upper edge of the flush water distributor. The projections on the flush rim apron and the bowl are dimension and distributed so that they engage with opposing edges of the distributor and keep it under tension therebetween. The projections on the apron are engaged by one edge of the distributor from below and the projections on the bowl wall are engaged by the other edge of the distributor from above.

The distributor and ultimate siphon closet containing the distributor of the present invention is inexpensive and can be easily and efficiently manufactured. The distributor can be installed in a non-complicated manner. It is only flexed and pressed into the open flush rim from below. Preferably, the strip of material forming the water distributor is made of a punched piece of material which is therefore cheap to produce. Special mounting elements are not necessary. The projections at the upper bowl wall and the flush rim apron cause no additional cost. When the distributor is mounted in the siphon closet it is not visible and can practically only be removed again by an expert and/or by the use of special tools.

In summary, a water distributor is provided which is adapted for use in a siphon closet of the type provided with an open flush rim. The distributor includes a strip of material adapted to be inserted and positioned in a siphon closet to at least partially close the open flush rim therein. An arrangement of apertures are in the distributor to form passageways from the at least partially closed flush rim.

With the above objectives of the present invention among others in mind, reference is made to the attached drawings.

DESCRIPTION OF THE PREFERRED EMBODIMENT

Figure 3:
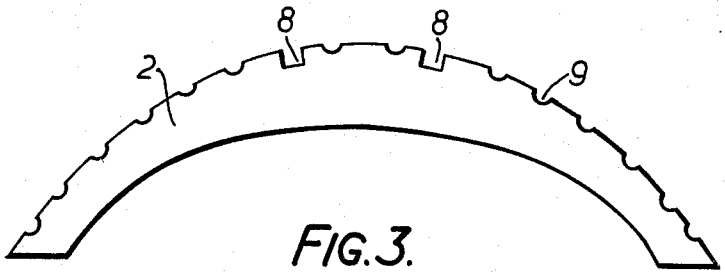
FIG. 3 is a plan view of a flush water distributor of the invention prior to assembly in siphon closet.

Flush rim 1 is open in a downward direction and is partially closed by means of a flush water distributor consisting of a flat strip of material. Distributor 2 has a larger radius of curvature than flush rim 1 in an unflexed condition before it is flexed and inserted into flush rim 1. Distributor 2 in the unflexed condition is depicted in FIG. 3. It has been found that a relatively strong but somewhat flexible material such as stainless steel or a plastic like polypropylene, polyethylene or polyvinylchloride will be satisfactory for the distributor 2.

The distributor is mounted by flexing the strip sufficiently for insertion into the flush rim 1. The flexed strip is then positioned in the rim and released. It will then tend to return to its initial configuration and thereby engage or snap into engagement with the adjacent surfaces of the rim.

Figure 1:
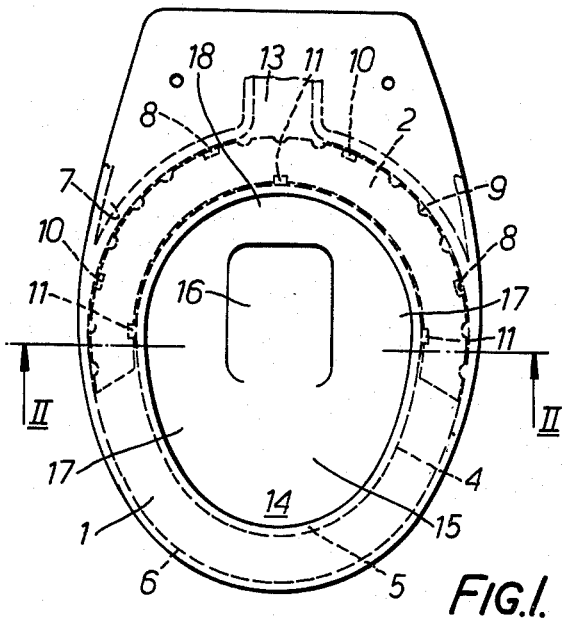
FIG. 1 is a top plan view of a siphon closet incorporating a distributor according to the present invention.
Figure 2:
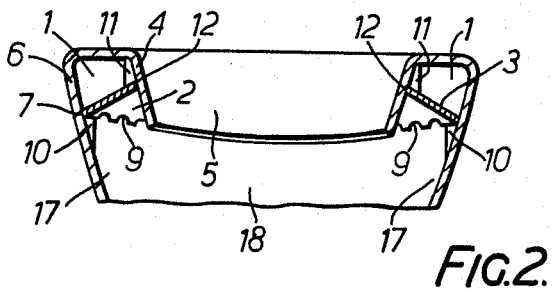
FIG. 2 is a fragmentary sectional elevation view thereof taken along the plane of line II—II of FIG. 1.

After being mounted in position, the distributor 2 forms a wall 3 running diagonally in the cross section, as shown in FIG. 2. It engages and is attached to the interior wall 4 of the flush rim apron 5 at the upper edge of distributor 2 and engages and is attached to the bowl wall 6 at the lower edge of the distributor 2. It can be seen that the lower edge 7 of distributor 2, attached to the flush rim 1 at the upper bowl wall 6, is provided with recesses 8, 9. The larger recesses 8 cooperate with projections 10 at the bowl wall 6, while the smaller recesses 9 form passage apertures in conjunction with the adjacent bowl wall 6 which are directed downward. The flush rim apron 5 has projections 11 directed inwardly toward the adjacent bowl wall. The projections 11 are engaged from below by the upper rim 12 of distributor 2. The distributor is maintained in flexed condition under tension between the projections 10 at the upper bowl wall on one hand and the projections 11 at the flush rim apron on the other hand. Distributor 2 is arranged so that it is not visible and it can practically only be removed again by an expert or at least by the use of special tools.

The siphon closet incorporating the water distributor of the present invention operates in the same manner as the above discussed known designs. The water, coming through the inlet 13 into the flush rim 1, is divided into two main flush water flows. One flow is conducted along the left side and the other along the right side mainly along the upper bowl wall 6 to the front region 14 of the bowl 15 where they meet and clash. From that point, they stream into the outlet funnel 16. Partial quantities of these main flush water flows flush the side walls 17 and the rear region 18 of the bowl 15 in a well known manner.

The above described and depicted design of the present invention is only one embodiment of the invention. As already mentioned, naturally there are other possibilities within the present concept especially regarding the special arrangement and shaping of the flush water distributor. It would also be possible to provide the distributor in the unflexed condition with the same radius of curvature as the flush rim before it is installed. Upon installation, the distributor would provide a horizontal wall in the cross section. Also, the distributor could be shell-shaped in the cross section. In all of the embodiments the open flush rim is at least partially closed in the downward direction only by means of the flush water distributor consisting of a strip of material. This arrangement avoids the prior known expensive water distributors such as those in the shape of parts of sanitary ceramics which are inserted into the pre-casting or bonded on or in the shape of hollow bodies separately manufactured and later built in.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A water distributor adapted for use in a siphon closet of the type having an open flush rim, the distributor comprising:

a strip of relatively rigid, generally flat but sufficiently flexible material adapted to be inserted and positioned under tension in a siphon closet to at least partially close the open flush rim therein, said strip being arcuately formed and having a generally larger radius of curvature in its unflexed position than said flush rim and said strip having an arrangement of apertures formed therein to provide passageways from the at least partially closed flush rim.

2. The invention in accordance with claim 1 wherein the strip of material is flat and bent into an arcuate configuration and having a limited amount of flexibility, the strip having a larger radius of curvature than the arcuate flush rim of the siphon closet before insertion therein, the flush rim extending from the upper bowl wall of the siphon closet to form a flush rim apron, after flexing for insertion and positioning of the strip in the flush rim it forms a wall running diagonally in the cross section and attached to the interior wall of the flush rim apron at the top and the upper bowl wall at the bottom.

3. The invention in accordance with claim 2 wherein the apertures in the strip are formed by recesses formed along one edge of the strip, a plurality of projections on the bowl wall of the siphon closet for engagement with the one edge of the strip when the strip is mounted in the siphon closet, the recesses cooperating with the adjacent bowl wall to form the apertures providing passageways downward from the flush rim into the bowl of the siphon closet and being directed in a predetermined direction to facilitate water distribution from the flush rim into the bowl.

4. The invention in accordance with claim 3 wherein the flush rim apron is provided with a plurality of projections extending inwardly toward the upper bowl wall and positioned so that the other edge of the distributor engages the projections from below, the projections on the apron being arranged with respect to the projections on the upper bowl wall so that the strip is captured therebetween under tension when the strip is mounted in the siphon closet.

5. The water distributor of claim 1 wherein said strip is made of a flexible stainless steel.

6. The water distributor of claim 1 wherein said strip is made of a material selected from the group consisting of polyethylene, polypropyolyne, and polyvinylchloride.

* * * * *